United States Patent [19]

Huang

[11] Patent Number: 4,892,278

[45] Date of Patent: Jan. 9, 1990

[54] REVOLVING SHAFT CONTROLLED MOVABLE LAMP STAND

[76] Inventor: Soddy Huang, 2F, No. 31, Lane 57, Tung Shun St., Shulin, Taipei Hsien, Taiwan

[21] Appl. No.: 307,878

[22] Filed: Feb. 7, 1989

[51] Int. Cl.[4] ..... F21V 21/14

[52] U.S. Cl. ..... 248/124; 248/284; 362/427; 362/285

[58] Field of Search ..... 248/280.1, 281.1, 123.1, 248/124, 284, 324; 362/427, 285, 401; 74/89.2, 89.21, 89.22

[56] References Cited

U.S. PATENT DOCUMENTS

| | | | |
|---|---|---|---|
| 612,772 | 10/1898 | Haebler | 248/284 |
| 3,219,303 | 11/1965 | Stryker | 248/280.1 |
| 3,417,953 | 12/1968 | Hillquist | 248/284 |
| 3,790,773 | 2/1974 | Sapper | 248/123.1 |
| 4,213,591 | 7/1980 | Jaakkola | 248/281.1 |
| 4,280,172 | 7/1981 | Krogsrud | 362/427 |
| 4,494,177 | 1/1985 | Mathews | 362/285 |
| 4,595,970 | 6/1986 | Diffrient | 362/427 |
| 4,652,068 | 3/1987 | Boekholt | 362/427 |

FOREIGN PATENT DOCUMENTS

| | | | |
|---|---|---|---|
| 2555291 | 5/1985 | France | 362/285 |
| 362143 | 7/1962 | Switzerland | 362/285 |

*Primary Examiner*—Ramon O. Ramirez
*Assistant Examiner*—Robert A. Olson
*Attorney, Agent, or Firm*—Lowe, Price, LeBlanc, Becker & Shur

[57] ABSTRACT

A revolving shaft controlled movable lamp stand, which includes a stand, a driving mechanism, and a lamp socket, and is characterized in that: the lower revolving shaft and the upper revolving shaft and the driving mechanism each comprises a circular groove and a hole. Each said hole comprises an end a and an end b. A rope is provided to wind round the upper and lower revolving shafts through the holes and circular grooves of the upper and lower revolving shafts, to further let one end of the rope, which comprises a screw rod, be screwed up with the other end of the rope, which comprises a fastening matching means, so as to form a closed circulation. By means of vertical displacement of the holder of the driving mechanism, the lower revolving shaft is driven to produce angular displacement to drive the upper revolving shaft, by means of the rope, to make a synchronous movement, so as to further let the upper revolving shaft drive the driven rod to displace vertically and to change the projecting position of the illuminator.

3 Claims, 3 Drawing Sheets

REVOLVING SHAFT CONTROLLED MOVABLE LAMP STAND

BACKGROUND OF THE INVENTION

The present invention is to provide a movable lamp stand, which make use of the relative constraint between revolving shafts and a rope to let the driven rod of the driving mechanism change the position of the illuminator.

In regular desk lamps, the projecting position adjustment of the lamp is normally made by turning a holder to drive a link rod to displace so as to change the position of the illuminator. This adjusting method provides poor accuracy. Further, after a certain period of operation, the link rod is easy to get loose, and the adjustment will become in applicable.

FIG. 2A is a fragmentary perspective detailed view of a portion of FIG. 2.

FIG. 2B is a fragmentary perspective detailed view of another portion of FIG. 2.

In order to settle said problems, a better driving and adjusting method is applied in the present invention, to let revolving shafts control the displacement of the lamp stand. The actuating rod of the driving mechanism is adjusted by means of a holder and a handle, while the driven rod of the driving mechanism is adjusted by means of the traction of a rope through the revolving shafts.

SUMMARY OF THE INVENTION

The present invention is to provide a revolving shaft controlled movable lamp stand, which includes a stand, a driving mechanism, and a lamp socket, and is characterized in that: the lower revolving shaft and the upper revolving shaft and the driving mechanism each comprises a circular groove and a hole. Each said hole comprises an end a and an end b. A rope is provided to wind round the upper and lower revolving shafts through the holes and circular grooves of the upper and lower revolving shafts, to further let one end of the rope, which comprises a screw rod, be screwed up with the other end of the rope, which comprises a fastening matching means, so as to form a closed circulation. By means of vertical displacement of the holder of the driving mechanism, the lower revolving shaft is driven to produce angular displacement to drive the upper revolving shaft, by means of the rope, to make a synchronous movement, so as to further let the upper revolving shaft drive the driven rod to displace vertically and to change the projecting position of the illuminator.

DETAILED DESCRIPTION OF THE PREFERRED EMBODIMENTS

Figure 1:
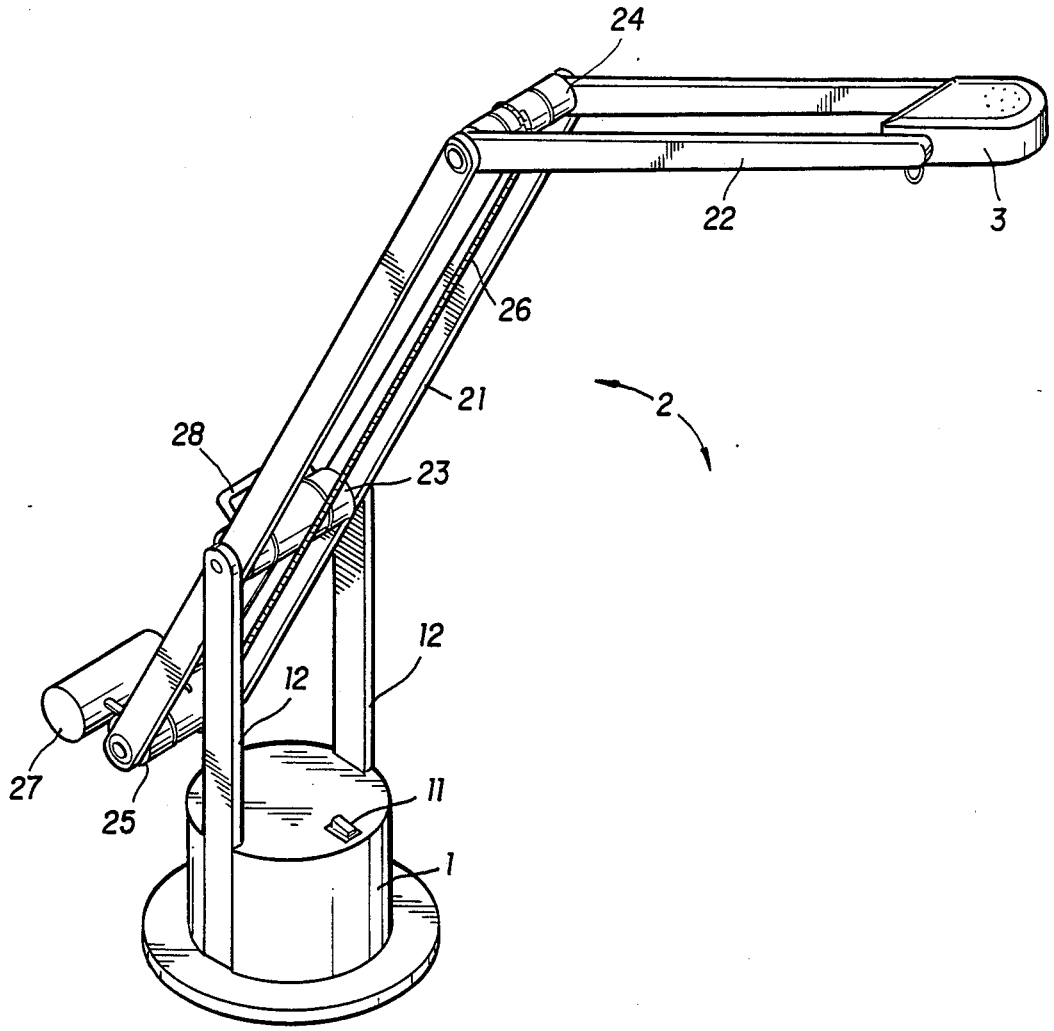
FIG. 1 is a perspective view of the present invention, illustrating the outer appearance of a movable lamp stand.
Figures 2, 2A, 2B:
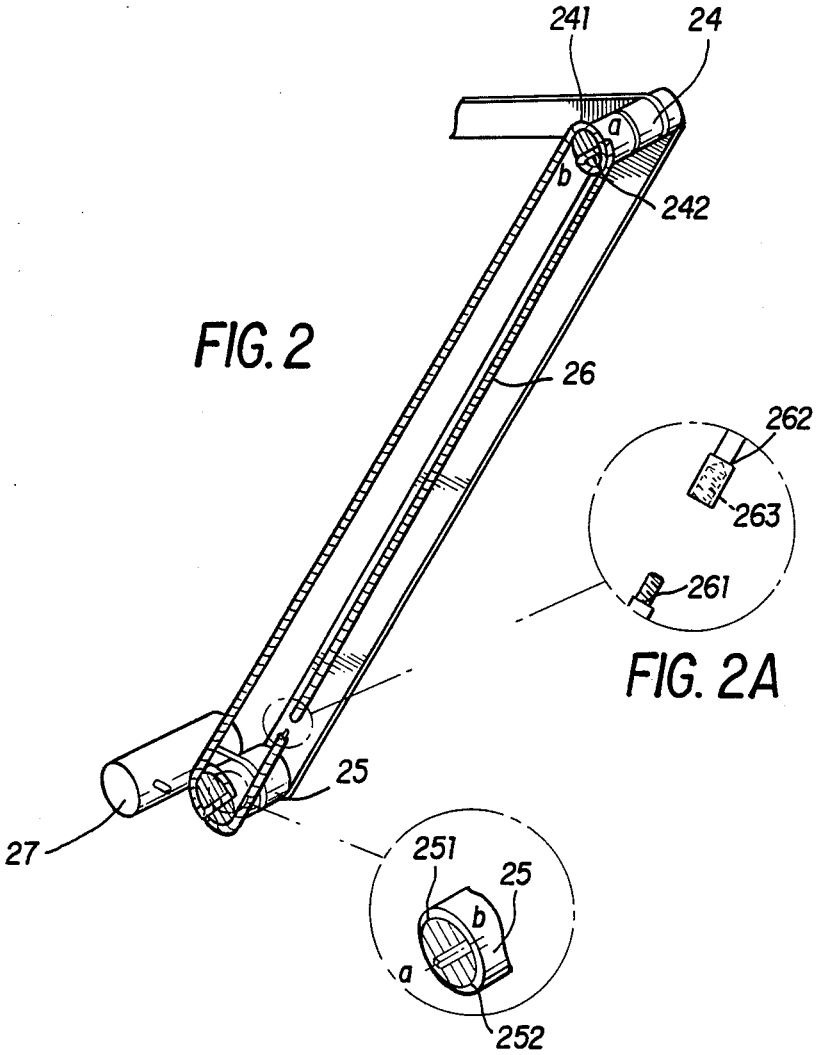
FIG. 2 is a partially perspective and sectional view of the present invention.
Figure 3:
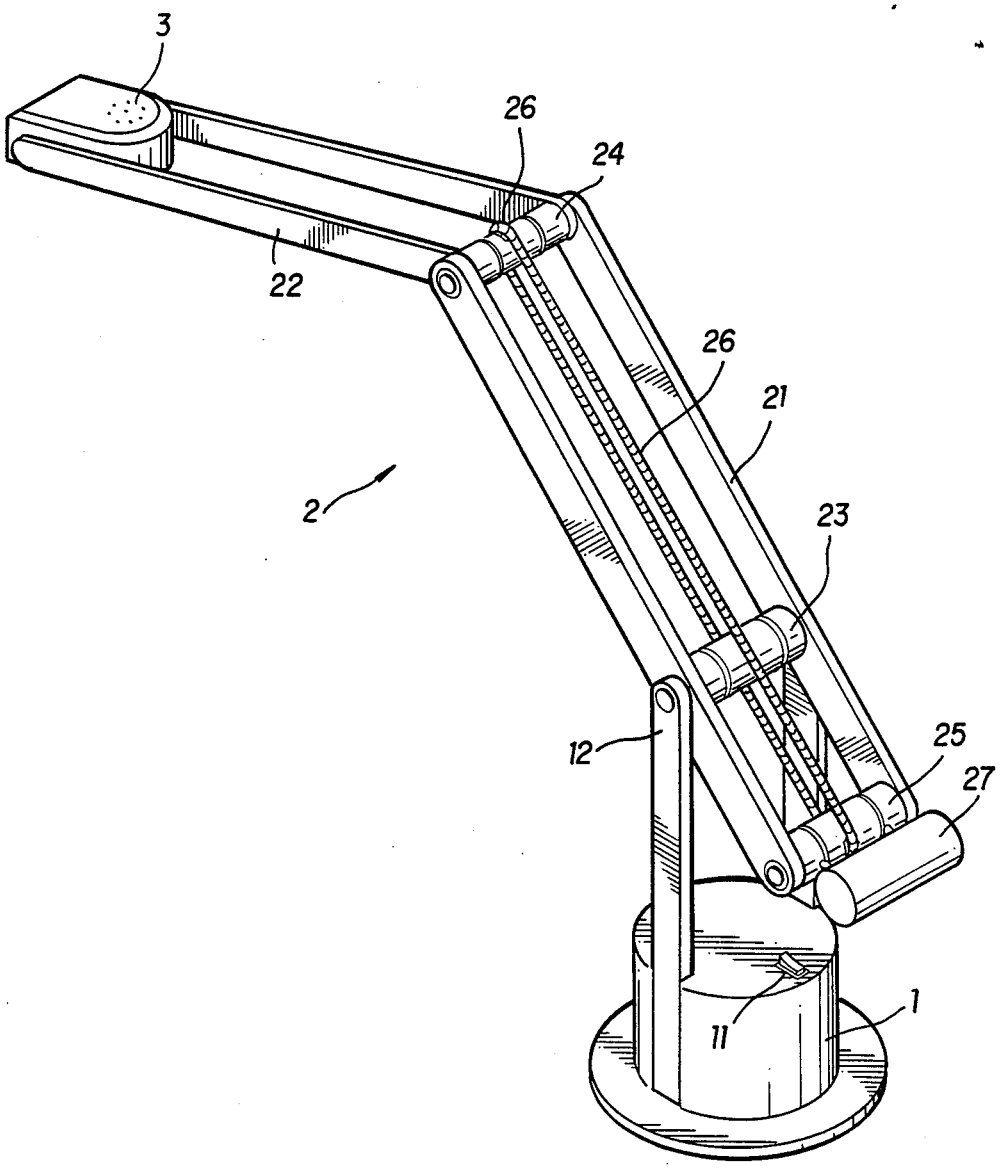
FIG. 3 is another perspective view of the present invention, illustrating the outer appearance of the movable lamp stand of FIG. 1 adjusted to another position.

Referring to FIGS. 1 through 3, a revolving shaft controlled movable lamp stand includes a stand (1), a driving mechanism (2) and a lamp socket (3). The said stand (1) includes a switch (11), and two supporting arms (12) bilaterially disposed. To said two supporting arms (12) are pivotally connected with the both ends of the locating axle (23) of the driving mechanism (2). The said lamp socket (3) is pivotally connected with the driven rod (22) of the driving mechanism (2). By means of said arrangement, the said stand, driving mechanism and lamp socket are connected together to form a desk lamp structure.

The said driving mechanism (2) is the main feature of the present invention, which comprises an actuating rod (21), a driven rod (22), a locating axle (23), an upper and a lower revolving shaft (24) and (25), and a rope (26). The said actuating rod (21) is connected with the said driven rod (22) by means of the said upper revolving shaft (24). A handle (28) is made on the said actuating rod (21) between the pivot connecteion of the said locating axle (23) with one of the said supporting arms (12) of the said stand (1). The said lower revolving shaft (25) is pivotally connected with the said actuating rod (21) at the bottom end. The said lower revolving shaft (25) comprises a holder (27). A rope (26) is provided to wind round the said lower and upper revolving shaft (25) and (24). By means of the dragging of the said rope (26) and the up-and-down adjustment of the said holder (27), the said lower revolving shaft (25) is driven to rotate in accordance with the displacment of the said holder (27). By means of the rotation of the said lower revolving shaft (25), the said rope (26) drives the said upper revolving shaft (24) to make a synchronous displacement. When the said upper revolving shaft (24) is driven to change its position, the position of the illuminator at the said lamp socket is concomitantly driven to displace.

According to the present invention, the said actuating rod (21) of the said driving mechanism (2) is directly adjusted by means of the said holder (27) and the said handle (28), and the lamp socket (3) is designed for 360° rotation for angle adjustment of the illuminator.

In the present preferred embodiment. the said rope (26), which winds round the said upper and lower revolving shafts (24) and (25), comprises a screw rod (261) at one end and a fastener matching means (262) at the other end. When in installation, the end of the said screw rod (261) of the said rope (26) is inserted into the hole (242) on the said upper revolving shaft (24) from point a through point b to turn a round around the circular groove (241) of the said upper revolving shaft (24) to further pass downward to the said lower revolving shaft (25) and to insert into the hole (252) from point a through point b, and then to further turn round around the circular groove (251) of the said lower revolving shaft (25) to connect to the fastening machine means (262) of the other end of the said rope (26) by screwing up the said screw rod (261) with the inner thread (263) of the said fastening matching means (262). By means of this arrangement, the said rope (26) forms a closed circulation which winds round the said upper and lower revolving shaft (24) and (25) (as shown in FIG. 2).

According to the above-described embodiment, the tension of the said rope may be adjusted by screwing up the said screw rod (261) with the said fastening matching means (262), or loosening the said screw rod (261) from the said fasteing matching means (262), so as to allow the said holer (27) become applicable for adjustment.

In general, the present invention is to provide such a revolving shaft controlled movable lamp stand having numerous features each of which tends to make the structure more practical, and convenient to operate.

I claim:

1. A revolving shaft controlled movable lamp stand including a stand, a driving mechanism, and an illuminator lamp socket comprising: said driving mechanism comprises an actuating rod having a bottom and an upper end and driven rod, both said actuating rod and said driven rod being pivotally connected by means of an upper revolving shaft; said stand comprising two supporting arms bilaterally disposed to pivotally connect with said actuating rod by means of a located rod; a lower revolving shaft being pivotally connected with said actuating rod at the bottom end thereof; a holder and a handle being made on said lower revolving shaft and said locating rod respectively; said lower revolving shaft and said upper revolving shaft each comprising a circular groove and a hole, each said hole comprising an end a and an end b; a rope being provided to wind round said upper and lower revolving shafts through said holes and circular grooves of said upper and lower revolving shafts, to further let one end of said rope, which comprises a screw rod, be screwed up with the other end of said rope, which comprises a fastening matching means, so as to form a closed circulation; by means of said arrangement, said actuating rod being adjusted to change position by means of the operation through said hole and said handle so as to change the projecting position of the attached illuminator; said driven rod being adjusted by means of the up-and-down displacement of said holder, to drive said lower revolving shaft to provide an angular displacement so as to further let said rope drive said upper revolving shaft to make a synchronous movement and to further let said upper revolving shaft drive said driven rod to displace up-and-down and to change the position of the attached illuminator.

2. A revolving shaft controlled movable lamp stand according to claim 1, wherein said rope winds round said upper and lower revolving shafts in a manner that the end of the said screw rod at one of said rope is inserted into the hole on said upper revolving shaft from a end through b end to turn a round around the circular groove on said upper revolving shaft to further pass downward to said lower revolving shaft and to insert into the hole one said lower revolving shaft from a end throubh b end, and then to further turn round around the circular groove on said lower revolving shaft to connect to said fastening matching means at the other end of said rope by screwing up said screw rod with the inner thread of said fastening matching means, so as to form a closed circulation.

3. A revolving shaft controlled movable lamp stand according to claim 1, wherein the tension of said rope is adjusted by screwing up said screw rod with said fastening matching means so as to allow the said holder to become applicable for adjustment.

* * * * *